United States Patent [19]

Wright

[11] 4,223,819

[45] Sep. 23, 1980

[54] SUITCASE WITH A BACK PACK ADAPTOR

[76] Inventor: Patrick P. Wright, c/o Serendipity Unlimited, Box 4386, Anchorage, Ak. 99509

[21] Appl. No.: 784,695

[22] Filed: Apr. 5, 1977

[51] Int. Cl.[2] ..... A45F 3/00

[52] U.S. Cl. ..... 224/211; 190/41 R

[58] Field of Search ..... 224/9, 8 R, 46 R, 47, 224/25 A, 25 R, 43, 44, 26 R, 6; 150/1.6, 1.7; 190/1, 15.1, 42, 57, 59, 60, 41 R; 248/311.1 R, 315, 359

[56] References Cited

U.S. PATENT DOCUMENTS

| | | | |
|---|---|---|---|
| 2,667,996 | 2/1954 | Fanelli | 224/46 R |
| 3,233,803 | 2/1966 | Gray | 224/8 R |
| 3,648,907 | 3/1972 | Romney | 224/25 A |
| 4,066,195 | 1/1978 | Dickler | 224/8 R |
| 4,074,839 | 2/1978 | Wood et al. | 224/8 R |

*Primary Examiner*—Kenneth W. Noland

*Attorney, Agent, or Firm*—Burns, Doane, Swecker & Mathis

[57] ABSTRACT

A pack frame with a canvas panel attached by straps to the front of the pack frame can be supported on a user's back using shoulder straps and a waistband, a pack sack may be attached using hooks to the front of the pack frame and slots formed in the pack frame can permit the attachment of a suitcase to the pack frame by means of a strap attached around the suitcase and through the slots, a handle on the suitcase permits the carrying of the suitcase in the conventional manner with the pack frame and back pack inserted in the suitcase.

7 Claims, 7 Drawing Figures

SUITCASE WITH A BACK PACK ADAPTOR

I have invented a new and novel suitcase with a back pack adaptor. This adaptor can be placed in the suitcase when the suitcase is not being worn on the back of the user as a back pack. A hiking pack sack may be attached to the rear surface of the back pack adaptor for use on short trips in wilderness areas while the back pack adaptor when inserted in the suitcase permits the suitcase to be carried in the conventional manner in urban situations.

My invention can be understood in view of the accompanying figures.

Figure 1:
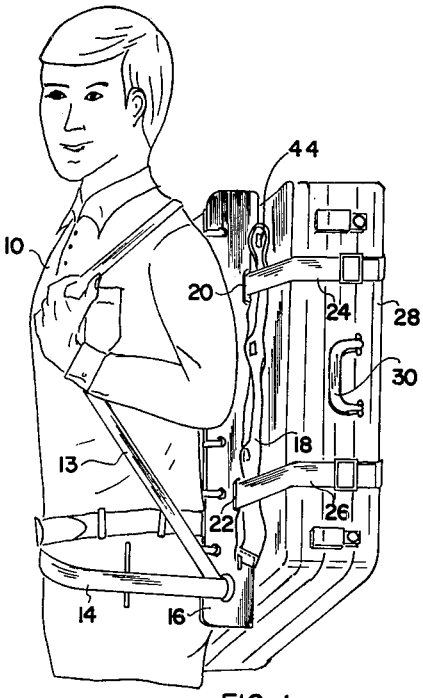
FIG. 1 is a side view of the back pack adaptor mounted on a person bearing the suitcase.
Figure 2:
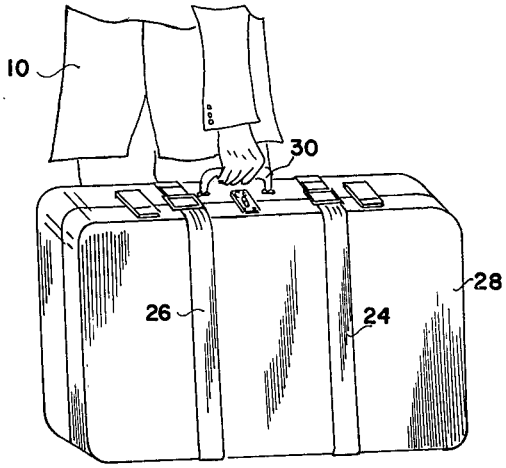
FIG. 2 is a side view of the suitcase containing the adaptor being carried in the conventional urban manner.
Figure 5:
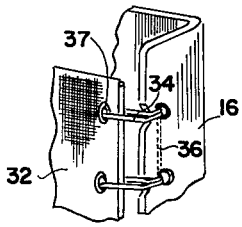
FIG. 5 is a close up of the connection of the canvas panel to the back pack frame.
Figure 3:
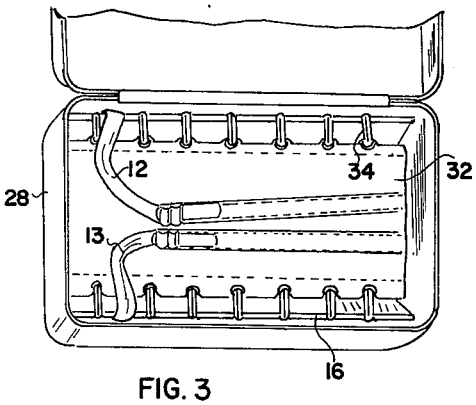
FIG. 3 is a top view looking into the suitcase opened showing the storage of the back pack adaptor in the suitcase.
Figure 4:
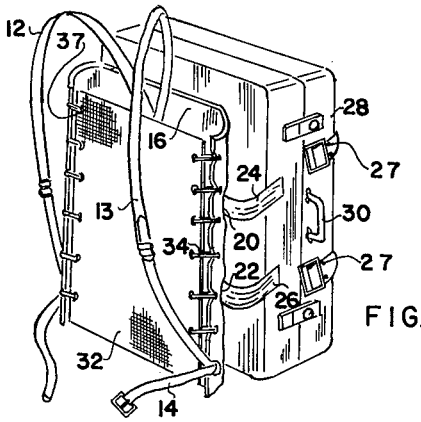
FIG. 4 is a perspective view of the back pack adaptor being connected to the suitcase.

With regard to FIGS. 1, 2, 3, 4, and 5, a man 10 can place shoulder straps 12 and 13 and a waistband 14 which are attached to a pack frame 16 around his body. On the rear of the molded plastic pack frame 16 a pack sack 18 can be supported. Slots 20 and 22 in the pack frame 16 can accept mounting straps 24 and 26 which are pop riveted to a steel suitcase 28 by pop rivets 27 and can go around the suitcase 28 to secure the suitcase to the back of the pack frame 16 so that the person 10 can carry the suitcase 28 as a back pack. The handle 30 on the top of the suitcase 28 permits the user 10 to also carry the suitcase 28 in the conventional manner.

A canvas panel 32 can be attached to the front of the pack frame 16 by straps 34 and the straps 34 can be connected 36 between the grommets 37 in the canvas panel 32 and the pack frame 16 to form a continuous supporting network so that the canvas panel 32 can comfortably rest against the user's back.

Figure 6:
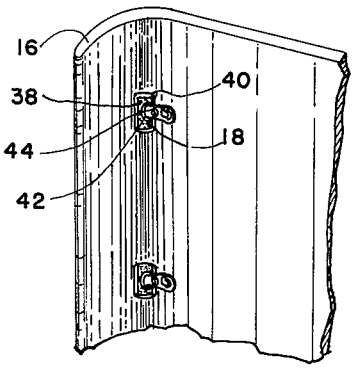
FIG. 6 shows the connection of the pack sack to the frame as seen from the inside of the pack frame.
Figure 7:
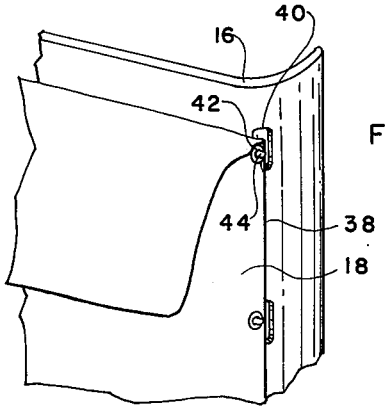
FIG. 7 is a view of the back pack adaptor as seen from the rear.

With regard to FIGS. 6 and 7, a grommet 42 in the edge 38 of the pack sack 18 can engage a hook 44 attached to the back of the pack frame 16 and protruding through a hole 40 formed by the frame 16 to hold the pack sack 18.

The pack frame 16 can be made of a laminated wood construction which is very strong and durable or molded from plastic and the suitcase can be of the molded plastic type which is light and strong or of the steel type such as an American Tourister suitcase.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A back pack adaptor for a suitcase, comprising:

a pack frame with a plurality of holes formed therein;

means of attaching the pack frame to a back of a user, including a set of shoulder straps attached to a front of the pack frame and a waistband attached to a lower portion of the pack frame;

a suitcase removably attachable to the pack frame;

a pack sack removably attachable to the pack frame and supportable between the pack frame and the suitcase;

a hook attached to an inner edge of the frame adjacent to one of the holes in the back frame and removeably attached to a grommet located in an edge of the pack sack, and a canvas panel attached by means of a strap to the front of the pack frame, wherein the means of attaching the suitcase to the pack frame comprises the pack frame forming a pair of slots, and a strap, attached to the suitcase by a plurality of pop rivets, insertable through the slots and attachable around the suitcase, whereby the suitcase may be attached to the pack frame.

2. The back pack adaptor of claim 1, wherein the pack frame is made of a laminated wood material.

3. The back pack adaptor of claim 2, wherein the suitcase is made of a molded plastic material.

4. The back pack adaptor of claim 1, wherein the pack frame is made of a molded plastic.

5. The back pack adaptor of claim 4, wherein the suitcase is made of steel.

6. A convertible back pack-suitcase apparatus comprising:

a suitcase;

a back frame dimensioned so that the back frame can be carried within the suitcase when the apparatus is used as a suitcase;

a pack sack removably attachable to the back frame and supportable between the back frame and the suitcase;

a canvas panel attached to the front of the back frame; shoulder straps for attaching the back frame to the back of a user when the apparatus is used as a back pack; and suitcase straps, permanently attached to the suitcase, to facilitate securing the suitcase closed when the apparatus is used as a suitcase and for engaging the back frame to secure the suitcase to the back frame when the apparatus is used as a back pack.

7. A convertible back pack-suitcase apparatus comprising:

a suitcase;

a back frame dimensioned to be carried within the suitcase;

shoulder straps and waistband for securing the back frame to the back of a user;

a canvas panel attached to the front of the back frame, and a buckle and strap for encircling the suitcase to secure the suitcase closed, said strap being permanently attached to the suitcase wherein said strap is adapted to be threaded through slots in the back frame and simultaneously encircle the suitcase to secure the suitcase to the back frame, whereby the apparatus functions as a back pack.

* * * * *